US007845468B2

(12) United States Patent
Steblinski

(10) Patent No.: US 7,845,468 B2
(45) Date of Patent: Dec. 7, 2010

(54) LADDER BRACKET

(75) Inventor: Thomas John Steblinski, Medina, OH (US)

(73) Assignee: Independence Excavating, Inc., Independence, OH (US)

( * ) Notice: Subject to any disclaimer, the term of this patent is extended or adjusted under 35 U.S.C. 154(b) by 993 days.

(21) Appl. No.: 11/344,619

(22) Filed: Feb. 1, 2006

(65) Prior Publication Data

US 2007/0175699 A1 Aug. 2, 2007

(51) Int. Cl.
*E04G 3/22* (2006.01)

(52) U.S. Cl. ..... 182/93; 211/118; 211/175; 248/226.1; 248/228.3

(58) Field of Classification Search ..... 182/93, 182/107, 206; 211/85.7, 18, 90.01, 90.02, 211/100, 106.01, 118, 175; 248/226.1, 228.3
See application file for complete search history.

(56) References Cited

U.S. PATENT DOCUMENTS 1,018,877 A * 2/1912 Chickering ..... 182/206
3,491,852 A * 1/1970 Leist ..... 182/117
4,765,439 A * 8/1988 Kresmery ..... 182/107
5,810,304 A * 9/1998 Lehrman ..... 248/215
2005/0045421 A1* 3/2005 Gaines ..... 182/107
2006/0124394 A1* 6/2006 Bracken et al. ..... 182/107
2007/0175699 A1* 8/2007 Steblinski ..... 182/82

* cited by examiner

*Primary Examiner*—Katherine Mitchell
*Assistant Examiner*—Daniel Cahn
(74) *Attorney, Agent, or Firm*—Calfee, Halter & Griswold

(57) ABSTRACT

A ladder bracket for hanging a ladder in a trench box is disclosed. The bracket includes a frame, a first arm and a second arm, and a lip. The first arm and second arm each have a first end attached to the frame and a second end extending in a direction away from the frame. The lip is attached to the second end of the first arm and to the second end of the second arm. A distance between the frame and the lip accommodates the bracket being removably hung from a top edge of the trench box. A method of use is also disclosed.

10 Claims, 4 Drawing Sheets

LADDER BRACKET

FIELD OF THE INVENTION

The present invention is directed to a bracket and more particularly to a ladder bracket for hanging a ladder in a trench box.

BACKGROUND OF THE INVENTION

Trenches are commonly dug at construction sites to perform a variety of excavating work. Access into and out of a trench box by a worker is typically afforded by a ladder. Certain federal government safety standards require that whenever a worker is within a trench box, a ladder must be present to allow for a means of egress in the event of an emergency. However, a long ladder tends to be in the way of the work being conducted in the trench box. Consequently, workers are tempted to remove the ladders from the trench boxes to allow increased work space within the trench box. As mentioned, such a practice may violate one or more federal government safety standards. Moreover, such a practice may lead to a life threatening situation in the event of an emergency requiring immediate evacuation of the trench box. Therefore, an apparatus to facilitate storage of a ladder within a trench box in needed in the art.

The ladder bracket of the present invention provides for a safe, convenient and accessible storage point for a ladder within a trench box. The ladder bracket attaches to the top edge of the trench box to provide a point of ladder storage. The ladder can be removed for use. In the event of an emergency, the ladder bracket also facilitates use of the ladder in the stored position. Adjustable screws allow the bracket to be matched to the width of the box and tightened to secure the bracket to the trench box.

SUMMARY OF THE INVENTION

In an embodiment of the present invention, a ladder bracket for hanging a ladder in a trench box is disclosed. The ladder bracket provides for a safe, convenient and accessible storage point for a ladder within a trench box. The ladder bracket has adjustable features to accommodate various trench box wall thicknesses.

Further features and advantages of the invention will become apparent from the following detailed description made with reference to the accompanying drawings.

DETAILED DESCRIPTION OF THE INVENTION

The Detailed Description of the Invention merely describes preferred embodiments of the invention and is not intended to limit the scope of the claims in any way. Indeed, the invention as described by the claims is broader than and unlimited by the preferred embodiments, and the terms in the claims have their full ordinary meaning.

A ladder bracket for hanging a ladder in a trench box is disclosed. The bracket provides for a safe, convenient and accessible storage point for a ladder within a trench box. The bracket attaches over the top edge of the trench box and gives workers within the trench box a place to hang a ladder. Thus, the ladder is out of the way while work is performed in the trench box.

In use, a worker first uses the ladder to enter the trench. Typically, the ladder merely rests against the trench wall top edge at an angle. After the last worker has entered the trench box, a worker lifts up the ladder and then slides the ladder downward until two of the ladder rungs contacts the bracket frame. The ladder is now is a stored position. The ladder bracket also has adjustable features to allow for hanging on various trench box wall thicknesses. Additional features prohibit movement of the ladder in the stored position.

Figure 1:
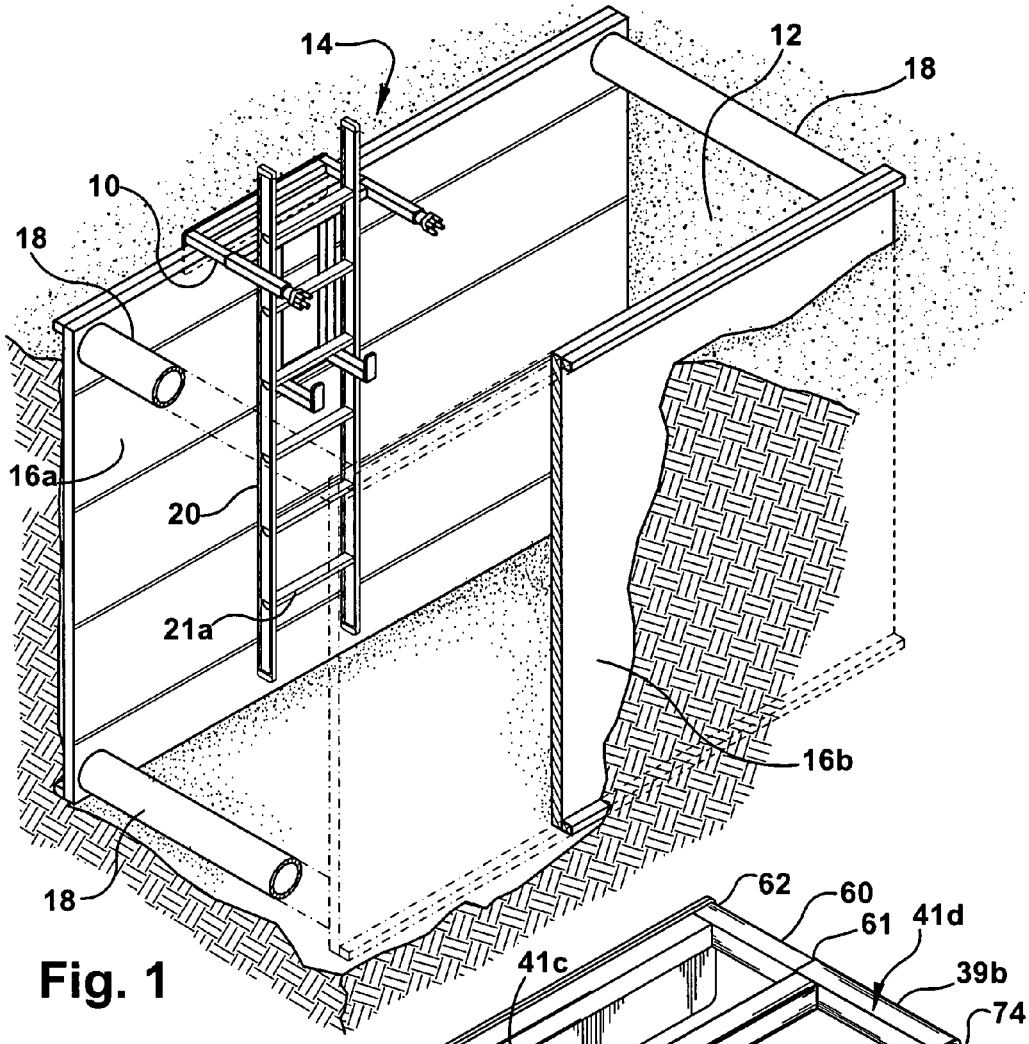
FIG. 1 is a perspective view of a ladder bracket made in accordance with an embodiment of the present invention, showing the ladder bracket attached to the top edge of a trench box and a ladder in a stored position.

Referring now to the drawings, FIG. 1 is a perspective view of a ladder bracket 10 made in accordance with an embodiment of the present invention. In FIG. 1, the bracket 10 is shown in an application environment. Specifically, an elongated trench 12 is formed below the ground surface 14. The trench is formed to allow for workers to perform a variety of tasks at a temporary work location below ground level. The trench 12 is defined by trench box walls 16*a*, 16*b* that are spaced apart by supporting beams 18. The trench shown in the Figures is for exemplary purposes only. It should be apparent to others with ordinary skill in the art that any trench size, design, or construction method can be utilized in the practice of the present invention.

In FIG. 1, the bracket 10 is shown in an installed position at the work site. The bracket 10 is attached to a top edge 24 of a trench box wall 16*a*. A ladder 20 is in a stored position hanging from the bracket 10. The ladder includes a series of equally spaced rungs 21*a*, 21*b*, 21*c*, 21*d*, 21*e*, 21*f*. It should be apparent to others with ordinary skill in the art that the bracket 10 is designed for use with any conventional sized ladder suitable for use at a construction site. As shown in the stored position, the ladder 20 is hanging off the ground and is generally parallel to the trench box wall 16*a*.

Figure 2:
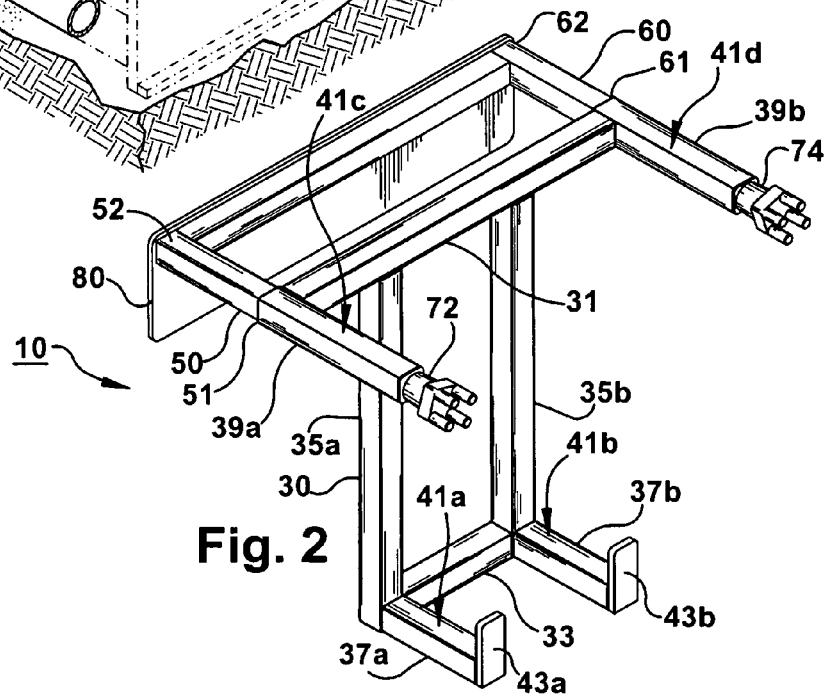
FIG. 2 is a perspective view of the ladder bracket of FIG. 1.
Figure 7:
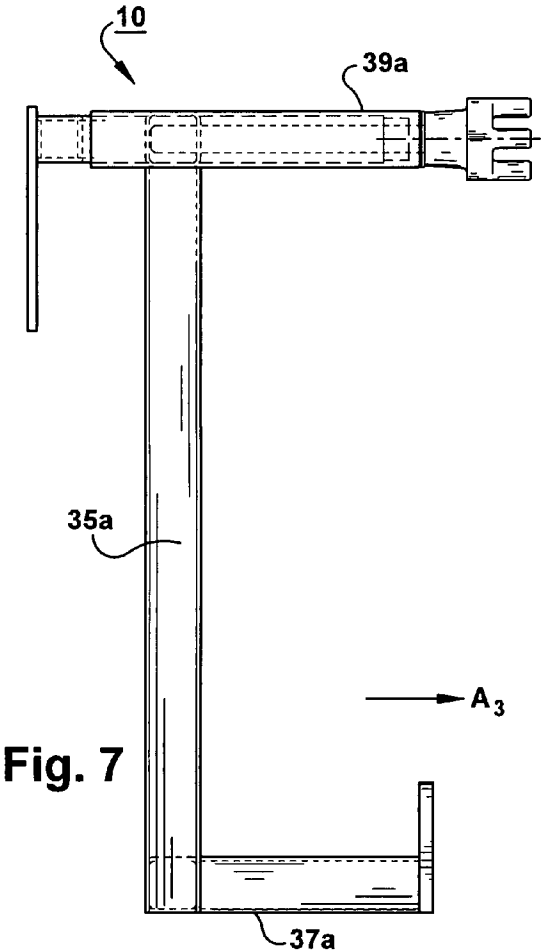
FIG. 7 is an enlarged side view of the ladder bracket of FIG. 1.
Figure 6:
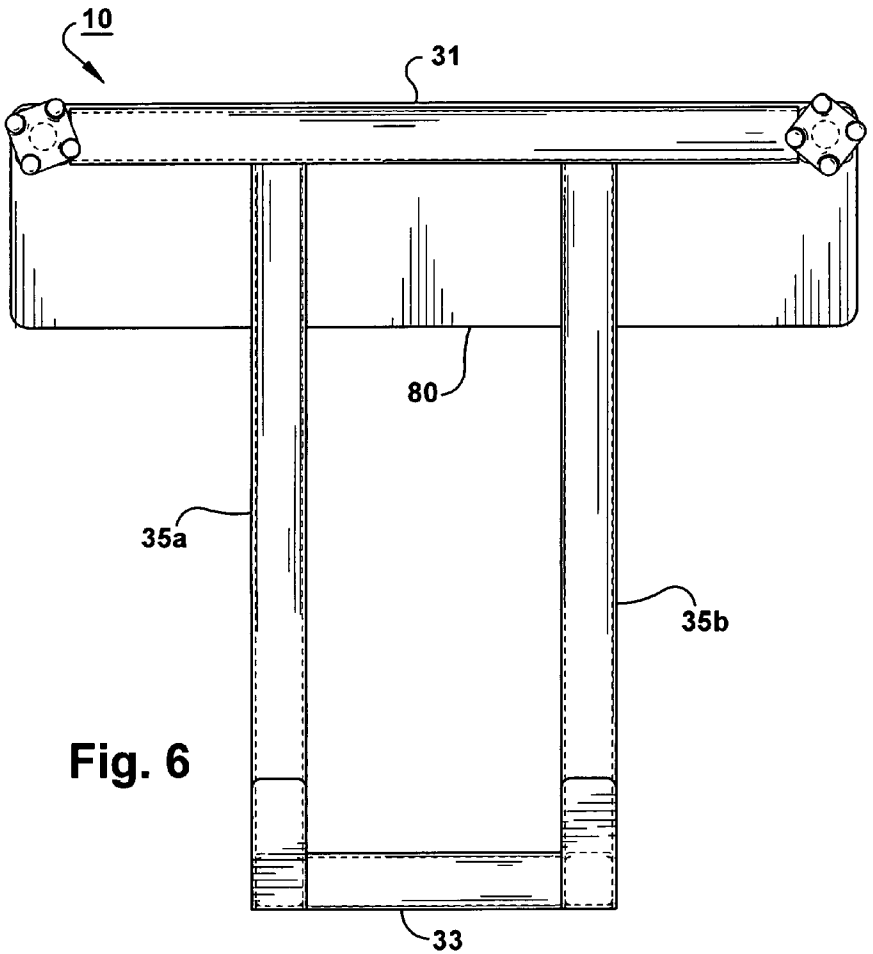
FIG. 6 is an enlarged front view of the ladder bracket of FIG. 1.

FIG. 2 is perspective view of the bracket 10 itself. For additional reference, FIG. 6 is an enlarged front view of the bracket 10 and FIG. 7 is an enlarged side view. The bracket 10 generally includes a frame 30, a first arm 50, and second arm 60, and a lip 80. The first arm 50 and second arm 60 generally extend out from the frame on the same side as the lip 80. The bracket made be constructed of steel or any other suitably strong and durable material.

The frame 30 is generally rectangular shaped and is formed by welding several steel beams. The frame must be of a sufficient strength to support the weight of a ladder in a stored position as shown in FIG. 1. In an embodiment, the frame must be of a sufficient strength to support the weight of a worker using the ladder in a stored position as shown in FIG. 1 to exit the trench box.

The main portion of the frame 30 includes an upper cross beam 31, a lower cross beam 33, and two side beams 35*a*, 35*b*.

The frame also includes several other extending portions. Adjacent the connection of either end of the lower cross beam 33, two stop members or stop beams 37*a*, 37*b* are attached. The stop beams 37*a*, 37*b* extend in a direction away from the main portion of the frame in a direction opposite the first arm 50 and second arm 60. Adjacent either end of the upper cross beam 31, two arm support members 39*a*, 39*b* are attached. The arm support beams 39*a*, 39*b* extend in a direction away from the main portion of the frame in a direction opposite the first arm 50 and second arm 60.

Figure 4:
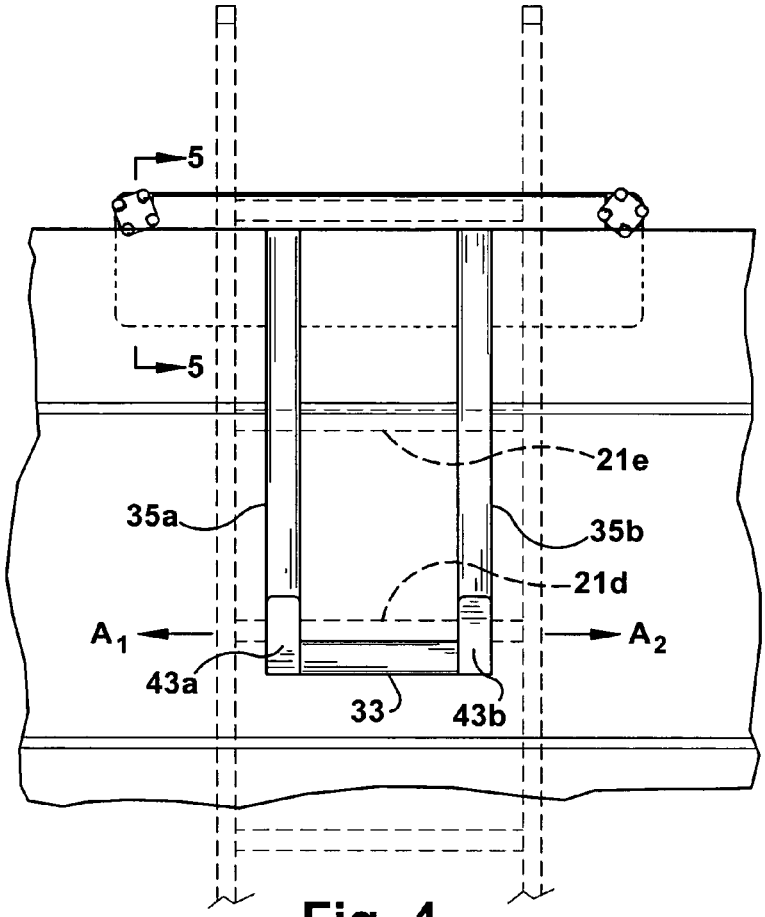
FIG. 4 is a front view of the ladder bracket of FIG. 1, showing the ladder bracket in an attached position.

The stop beams 37*a*, 37*b* are beneficial for several reasons. The stop beams 37*a*, 37*b* limit lateral movement of a ladder 20 hanging from the bracket 10. As best seen in FIGS. 1 and 4, the stop beams 37*a*, 37*b* extend between the two side beams 35*a*, 35*b*. As such, the ladder 20 hanging in the stored position is limited in movement in the direction $A_1$ or $A_2$ in FIG. 4. Other means for limiting lateral movement of a ladder hanging from the bracket can be used in the practice of the present invention.

The stop beams 37*a*, 37*b* also provide support surfaces 41*a*, 41*b*. In the stored position shown in FIGS. 1 and 3, the ladder rung 21*d* of the ladder 20 contacts the ladder support surfaces 41*a*, 41*b*. It should be apparent to others with ordinary skill in the art that other ladder support surface quantities or locations can be used in the practice of the present invention.

Movement of the ladder in the stored position is limited by an additional frame portion. Referring now to FIG. 4, a front view of the ladder bracket is shown with the ladder bracket in a stored position. At the outer end of the stop beams 37*a*, 37*b*, two hook members 43*a*, 43*b* are attached. The hooks 43*a*, 43*b* extend in a direction upward relative the stop beams 37*a*, 37*b* and toward the first arm 50 and second arm 60. The hook members 43*a*, 43*b* prohibit movement of a ladder 20 hanging from the bracket 10 in a direction away from the trench wall 16*a*. As best seen in FIGS. 1 and 4, the hook members 43*a*, 43*b* extend upward beyond the height of a ladder rung 21*d*. As such, the ladder 20 hanging in the stored position is limited in movement in the direction $A_3$ away from the lip 80, as shown in FIG. 7. Other means for limiting movement of a ladder in the direction $A_3$ can be used in the practice of the present invention.

As mentioned, the bracket 10 includes a first arm 50 and a second arm 60. The arms 50, 60 extend away from the main portion of the frame 30 and are attached to the lip 80. As shown, the first arm 50 and second arm 60 each have a first end 51, 61, respectively, attached to the frame 30 and a second end 52, 62, respectively, extending in a direction away from the frame 30. The attachment of the second ends 52, 62 to the lip 80 must be of sufficient strength to support the weight of the ladder 20 in the stored position. In an embodiment, the attachment of the second ends 52, 62 to the lip 80 must be of a sufficient strength to support the weight of a worker using the ladder in a stored position as shown in FIG. 1 to exit the trench box.

In the embodiment shown, the first arm 50 and the second arm 60 are movably attached to the frame 30. As such, a distance $D_1$ best seen in FIG. 5 from the lip 80 to the frame 30 is adjustable. The distance is adjustable by operator manipulation of a first adjustment member 72 attached to the first arm 50 and a second adjustment member 74 attached to the second arm 60. The adjustment structure as shown essentially the same in each arm 50, 60. For exemplary purposes only, the adjustment structure of the first arm 50 will be discussed, however, it should be apparent that unique adjustment structures could be used in each arm.

Figure 5:
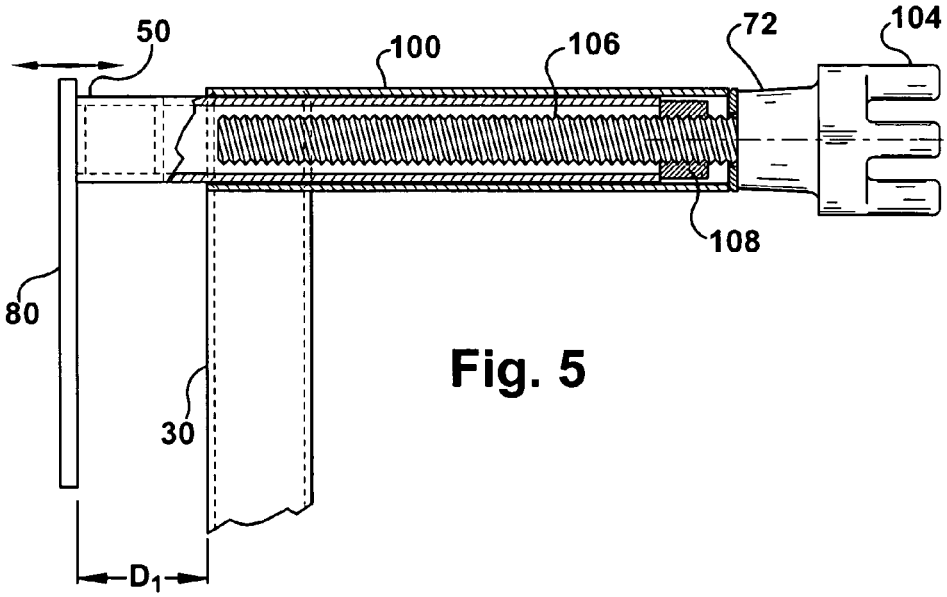
FIG. 5 is a side view, partially in section, of a portion of the ladder bracket of FIG. 1 as seen along the line 5-5 in FIG. 4, showing an adjustable feature of the ladder bracket.

Referring now to FIG. 5, the adjustable feature of the ladder bracket is shown. In order for the bracket to have increased application, it is adjustable to fit to different widths of the trench boxes. Various thicknesses of trench box walls are used, such as for example, 4" and 6". Adjustable screws are used to allow the bracket to be matched to the width of the box, and then tightened to secure the bracket to the trench box.

FIG. 5, is a side view, partially in section, of a portion of the ladder bracket as seen along the line 5-5 in FIG. 4. The first adjustment member 72 includes a knob 104, a sleeve 100, a block 108, and as threaded rod 106. As shown, the sleeve 100 is slidably attached over the first arm 50. The knob 104 is fixed to the sleeve 100 and the male-treaded rod 106. The block 108 includes a female threaded aperture through which the rod is engaged. As the knob 104 is rotated by a worker, the first adjustment member 72 moves relative to the frame 30. It should be understood by others with ordinary skill in the art that others adjustment structures may be used in the practice of the present invention.

As mentioned, the bracket 10 includes a lip 80 attached to the second end 52 of the first arm and to the second end 62 of the second arm. The lip 80 extends perpendicular from the first arm and second arm and generally parallel with the two side beams 35*a*, 35*b*. As shown in the FIGS., the lip 80 rests on the outer side flange of a trench box wall 16*a* when the bracket 10 is installed at the top edge 24 of the trench box 12. As described, the distance $D_1$ from the lip to the frame is adjustable to either tighten the bracket, or to accommodate various size trench wall thickness. Various means may be used to adjust this distance, including but not limited to, the means previously discussed.

Figure 3:
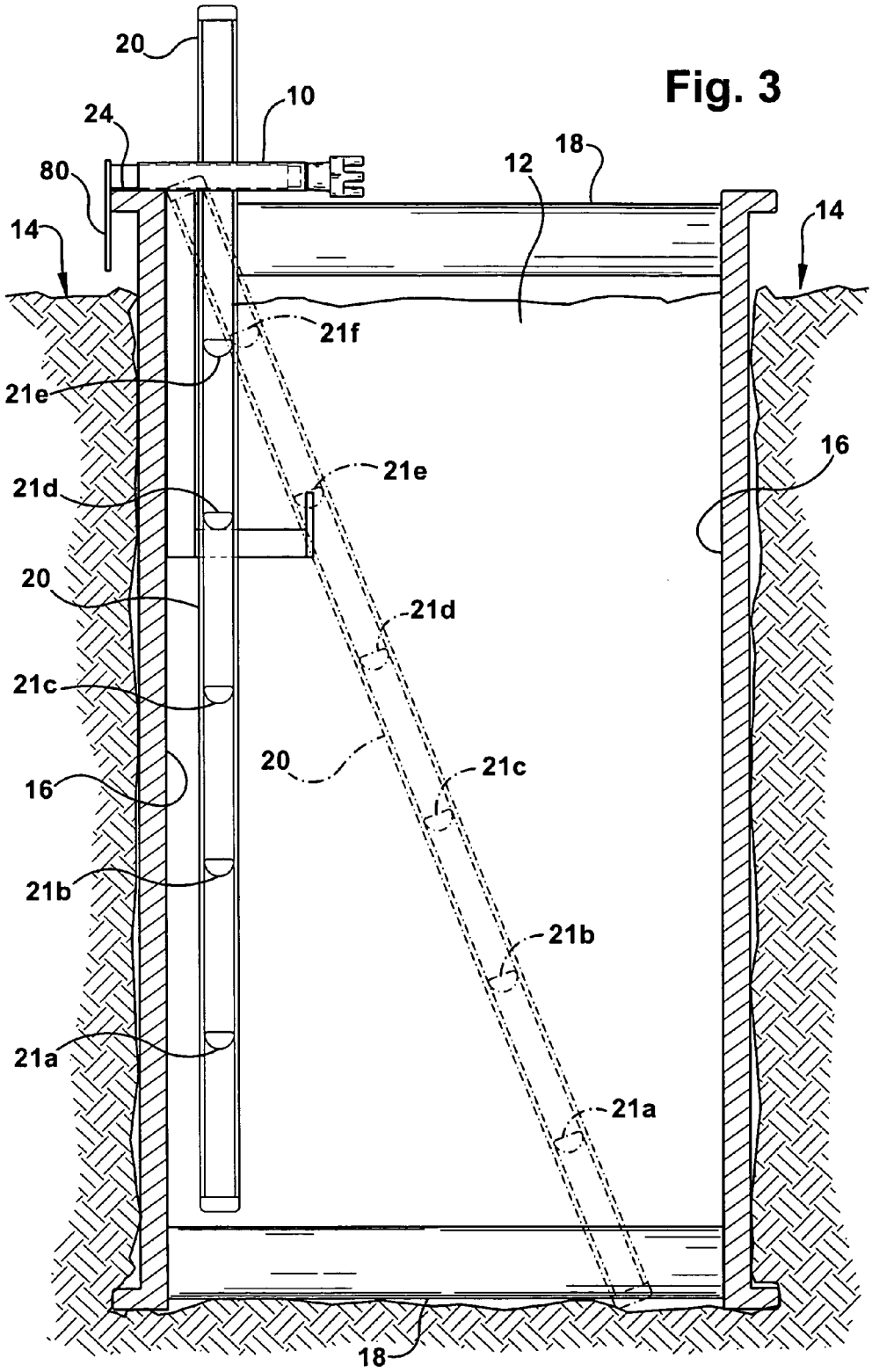
FIG. 3 is a side view of the ladder bracket of FIG. 1, showing the ladder bracket attached to the top edge of the trench box and the ladder in a stored position.

Operation of the ladder bracket and a method of use will be discussed. Referring now to FIG. 3, is a side view of the ladder bracket of FIG. 1 is shown. The ladder bracket is attached to the top edge of a trench box and the ladder is in a stored position. The ladder 20 is also shown in phantom lines in an operational position for entering and exiting the trench during normal conditions To initially enter the trench box, an operator places the ladder 20 in the position shown by the phantom lines. Subsequently, the ladder is stored within the trench box while not in use. The invention includes a method of storing a ladder in a trench box., including hanging a ladder bracket 10 on a top edge of the trench wall, and hanging a ladder 20 from the ladder bracket 10. As shown in the Figures, the ladder 20 is hanging parallel to a wall of the trench box and is not touching the ground. The ladder bracket can be adjusted to accommodate the thickness of the trench wall. In the event of an emergency or any other requirement, an operator may exit the trench box by use of the ladder with the ladder in the stored position.

While several embodiments of the invention has been illustrated and described in considerable detail, the present invention is not to be considered limited to the precise constructions disclosed. Various adaptations, modifications and uses of the invention may occur to those skilled in the arts to which the invention relates. It is the intention to cover all such adaptations, modifications and uses falling within the scope or spirit of the claims filed herewith.

What is claimed is:

1. A bracket in combination with a ladder, the combination is for mounting to a top edge of a trench box wall, the ladder comprising multiple rungs connecting between a pair of ladder stiles; the bracket comprising:

a) a frame having an upper cross beam, a lower cross beam parallel to said upper cross beam, a first side beam and a second side beam parallel to said first side beam, wherein a lower end of said first side beam is connected directly to a first end of said lower cross beam and a lower end of said second side beam is connected directly to a second end of said lower cross beam, and an upper end of said first side beam and an upper end of said second side beam are each respectively connected directly to said upper cross beam at separate locations between a first end and a second end of said upper cross member, such that a first portion of said upper cross member extends beyond said upper end of said first side beam in one direction and a second portion of said upper cross member extends beyond said upper end of said second side beam in an opposite direction;

b) a first arm and a second arm, said first arm having a first end connected to said first end of said upper cross member and said second arm having a first end connected to said second end of said upper cross member, wherein said first arm and said second arm each have a respective second end extending in a perpendicular direction away from said upper cross member;

c) a lip extending from said second end of said first arm to said second end of said second arm and disposed parallel to and spaced from said frame;

d) a first pair of ladder stop members, a first member of said first pair of stop members connected directly to said first end of said upper cross member, a second member of said first pair of stop members connected directly to said second end of said upper cross member, wherein said first pair of stop members extend in a perpendicular direction away from said frame in a direction opposite said first arm and said second arm, wherein said first pair of ladder stop members are spaced a first distance apart; and e) a second pair of ladder stop members, a first member of said second pair of stop members connected directly to a lower end of said first side beam, a second member of said second pair of stop members connected directly to a lower end of said second side beam, wherein said second pair of stop members extend in a perpendicular direction away from said frame in a direction opposite said first arm and said second arm, each of said second pair of ladder stop members disposed within said first distance relative to a longitudinal axis of said upper cross member, wherein said second pair of ladder stop members are spaced a second distance apart, and said first distance is greater than said second distance;

f) wherein all of said first member of said first pair of ladder stop members is co-axial with said first arm and all of said second member of said first pair of ladder stop members is co-axial with said second arm.

2. The bracket of claim 1 wherein said first arm and said second arm are of an adjustable length.

3. The bracket of claim 1 wherein a distance from said lip to said first end of said first arm and to said first end of said second arm is adjustable by a threaded fastener.

4. The bracket of claim 1 further comprising a first adjustment member attached to the first arm and a second adjustment member attached to the second arm.

5. The bracket of claim 1 wherein a distance from said lip to said frame is adjustable.

6. The bracket of claim 5 wherein said distance from said lip to said frame is adjustable to allow lateral movement of said bracket in a longitudinal direction along said top edge of said trench box wall.

7. The bracket of claim 1 wherein said first pair of ladder stop members and said second pair of ladder stop members define a range of lateral movement of a ladder hanging from said bracket.

8. The bracket of claim 1 wherein each of said second pair of ladder stop members comprise a hook extending in a direction toward said first arm and said second arm.

9. The bracket of claim 1 wherein each of said second pair of ladder stop members comprise a hook for limiting movement of a ladder hanging from said bracket in a direction away from said lip.

10. The bracket of claim 1 wherein said first and second members of said second pair of ladder stop members each respectively include a ladder support surface.

* * * * *